US005306161A

United States Patent [19]

Volz et al.

[11] Patent Number: 5,306,161

[45] Date of Patent: Apr. 26, 1994

[54] INTERFACE SYSTEM FOR ANGULARLY-CONVERGING PRINTED CIRCUIT BOARDS

[75] Inventors: Keith L. Volz, Jamestown; Robert M. Renn, Pfafftown; Frederick R. Deak, Kernersville; David C. Johnson, Winston Salem, all of N.C.

[73] Assignee: The Whitaker Corporation, Wilmington, Del.

[21] Appl. No.: 994,862

[22] Filed: Dec. 22, 1992

[51] Int. Cl.[5] ..... H01R 9/09

[52] U.S. Cl. ..... 439/66; 439/374

[58] Field of Search ..... 439/67, 74, 77, 31, 439/247, 248, 284–295, 493, 495, 496, 65, 66, 374, 376

[56] References Cited

U.S. PATENT DOCUMENTS

| | | | |
|---|---|---|---|
| 3,112,974 | 12/1963 | Curtis et al. | 439/680 |
| 4,971,575 | 11/1990 | Martellotti | 439/284 |
| 5,123,852 | 6/1992 | Gillett | 439/74 |

*Primary Examiner*—Neil Abrams
*Attorney, Agent, or Firm*—William B. Noll

[57] ABSTRACT

A pair of printed circuit boards (11, 12) angularly converge towards each other about a pivot axis (13). Each of the boards (11, 12) carries a connector housing (16). The connector housings (16) are identical, but are inverted end-to-end with respect to each other, such that a plurality of hermaphroditic guide fingers (19) on one of the connector housings (16) will mesh with a complementary plurality of guide fingers (19) on the other connector housing (16). The meshing engagement of the guide fingers (19) provides a guide means and a stop means between the connector housings (16) and hence between the printed circuit boards (11, 12). Each of the identical connector housings (16) further has a flexible electrical connector (17), and the flexible electrical connectors (17) engage each other when the printed circuit boards (11, 12) are fully converged. Inclined surfaces (21, 22) on the meshing guide fingers (19) provide a self-alignment feature as the printed circuit boards (11, 12) and the connector housings (16) thereon are angularly converged. Preferably, each connector housing (16) has spaced-apart pairs of bifurcated latching fingers (23) such that the connector housing (16) is "snapped" on to its respective printed circuit board (11, 12).

5 Claims, 6 Drawing Sheets

INTERFACE SYSTEM FOR ANGULARLY-CONVERGING PRINTED CIRCUIT BOARDS

FIELD OF THE INVENTION

The present invention relates to an interface system for converging printed circuit boards, and more particularly, to angularly-converging printed circuit boards, at least one of which is provided with a flexible electrical connector.

BACKGROUND OF THE INVENTION

Traditionally, mating printed circuit ("PC") boards are interconnected either perpendicular to each other, as in a backplane configuration for a personal computer, or parallel to each other in a stacked array. In some product applications, however, especially involving miniaturized housings which may include one or more curved walls, it is not feasible nor even possible to arrange the PC boards in the traditional parallel or perpendicular orientation. Rather, the product design may require that the PC boards be disposed angularly of each other and, more specifically, angularly converging towards each other about a pivot axis.

One, or both, of the angularly-converging printed circuit boards may include a connector housing provided with a flexible electrical connector. These flexible electrical connectors include a plurality of finely-divided circuit elements or traces on a thin flexible film wrapped about a suitable elastomeric core, as more fully described in AMP AMPLIFLEX Surface Mount Connectors, Catalog 82161 Revised August 1992, Copyright 1985 and 1991 by AMP Incorporated, Harrisburg, Pa. These traces may be gold-plated over a nickel-coated copper foil. Typically, the traces are 3 mils wide and are on 7 mils centers for a 4 mils spacing therebetween. A complete line of flexible electrical connectors is supplied by AMP Incorporated of Harrisburg, Pa. under its registered trademark "AMPLIFLEX".

It is imperative that as the angularly-converging printed circuit boards are pivoted together, that each flexible electrical connector is not damaged inadvertently by an edge of the connector housing on the other board.

SUMMARY OF THE INVENTION

Accordingly, it is an object of the present invention to provide an interface system for angularly-converging printed circuit boards, each of which is provided with a flexible electrical connector.

In accordance with the teachings of the present invention, there is herein disclosed and claimed, a preferred embodiment thereof for use in an electronic assembly, wherein a pair of identical connector housings is provided. Each of the identical connector housings includes at least one flexible electrical connector, and each of the identical connector housings further includes a plurality of spaced-apart hermaphroditic guide fingers. As a result, one of the connector housings may be turned over and fitted over the other connector housing, such that the hermaphroditic guide fingers mesh therebetween, thereby providing a stop means between the connector housings as the flexible electrical connectors engage each other.

Preferably, the connector housings are mounted on respective printed circuit boards which converge angularly towards each other about a pivot axis which is remote from the flexible electrical connectors.

Moreover, and in a preferred embodiment, each guide finger has a top surface extending upwardly of the connector housing, and each top surface is provided with a pair of spaced-apart beveled surfaces. As the connector housings are brought together, and as the guide fingers on the one connector housing mesh with the guide fingers on the other connector housing, the beveled surfaces on the one connector housing engage the beveled surfaces on the other connector housing, thereby aligning the guide fingers on the one connector housing with the guide fingers on the other connector housing. The connector housings are thus self-aligning as the connector housings are brought together.

These and other objects of the present invention will become apparent from a reading of the following specification taken in conjunction with the enclosed drawings.

BRIEF DESCRIPTION OF THE DRAWINGS

FIG. 3 corresponds substantially to FIG. 2 but shows the pivoted circuit boards fully converged, the hermaphroditic guide fingers on one connector housing being meshed with the guide fingers on the other connector housing to provide a stop means for the printed circuit boards, and the respective flexible electrical connectors engaging each other.

FIGS. 61–C are schematic sequence views, showing the manner in which the hermaphroditic guide fingers on one of the identical connector housings mesh with the corresponding guide fingers on the other (inverted) identical connector housing.

GENERAL DESCRIPTION OF THE PREFERRED EMBODIMENTS

Figure 1:
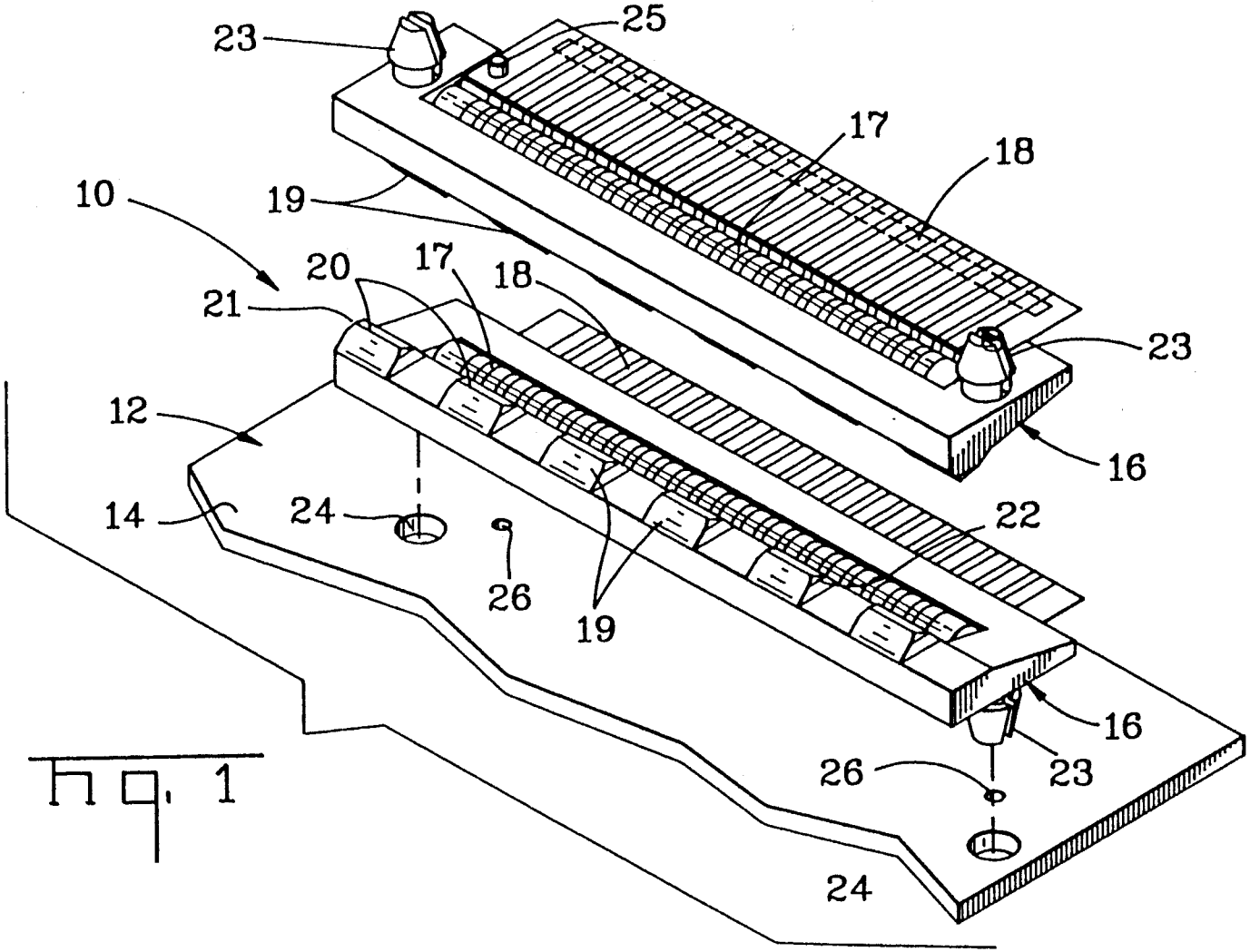
FIG. 1 is an exploded perspective of one embodiment of the present invention, wherein one of the connector housings is turned over (end to end) to mesh with an identical connector housing mounted on one of the printed circuit boards (the other printed circuit board being omitted for ease of illustration).
Figure 2:
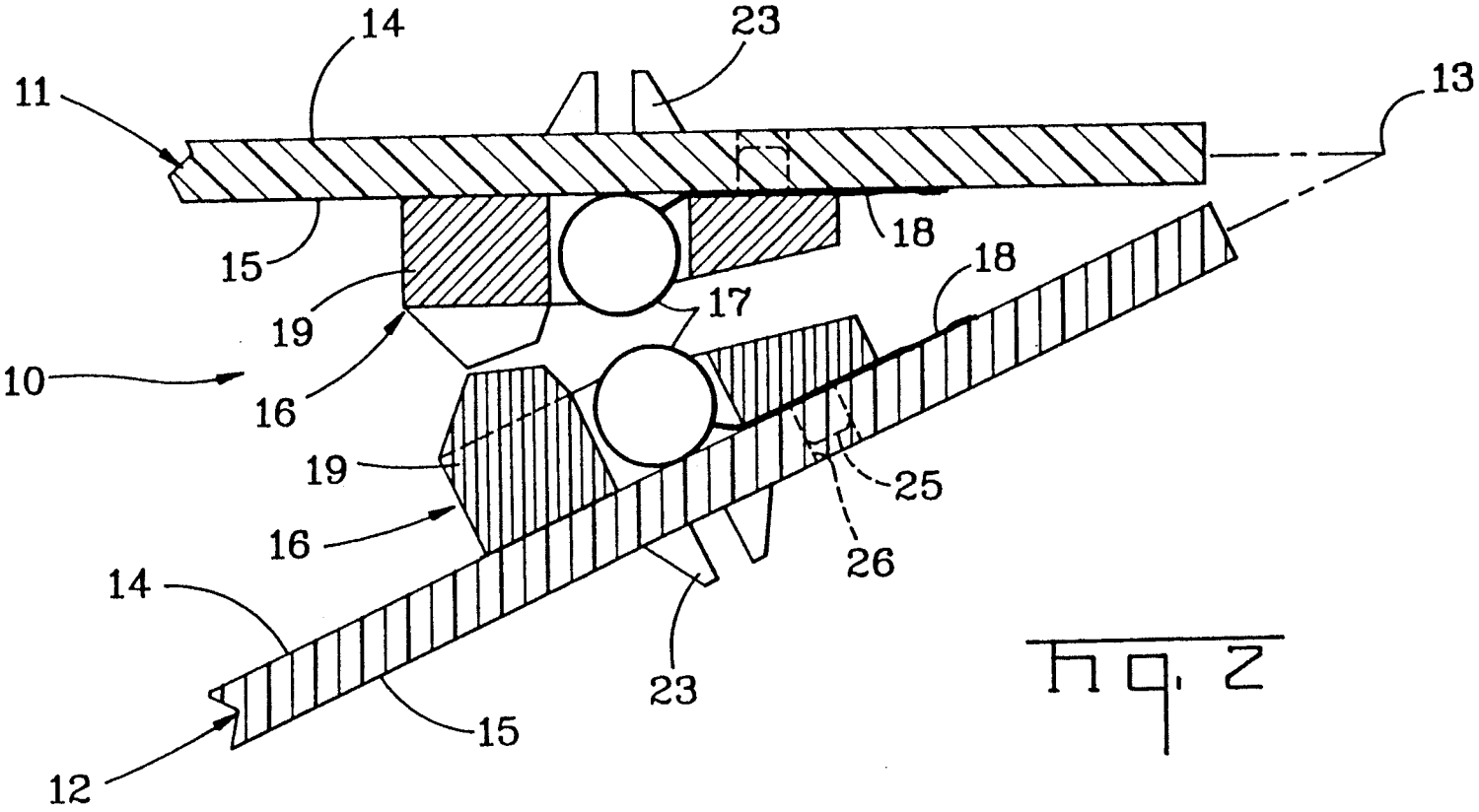
FIG. 2 is a schematic cross-sectional view thereof, showing the respective printed circuit boards angularly converging towards each other about a remote pivot axis, and further showing an identical connector housing on each of the printed circuit boards.
Figure 7:
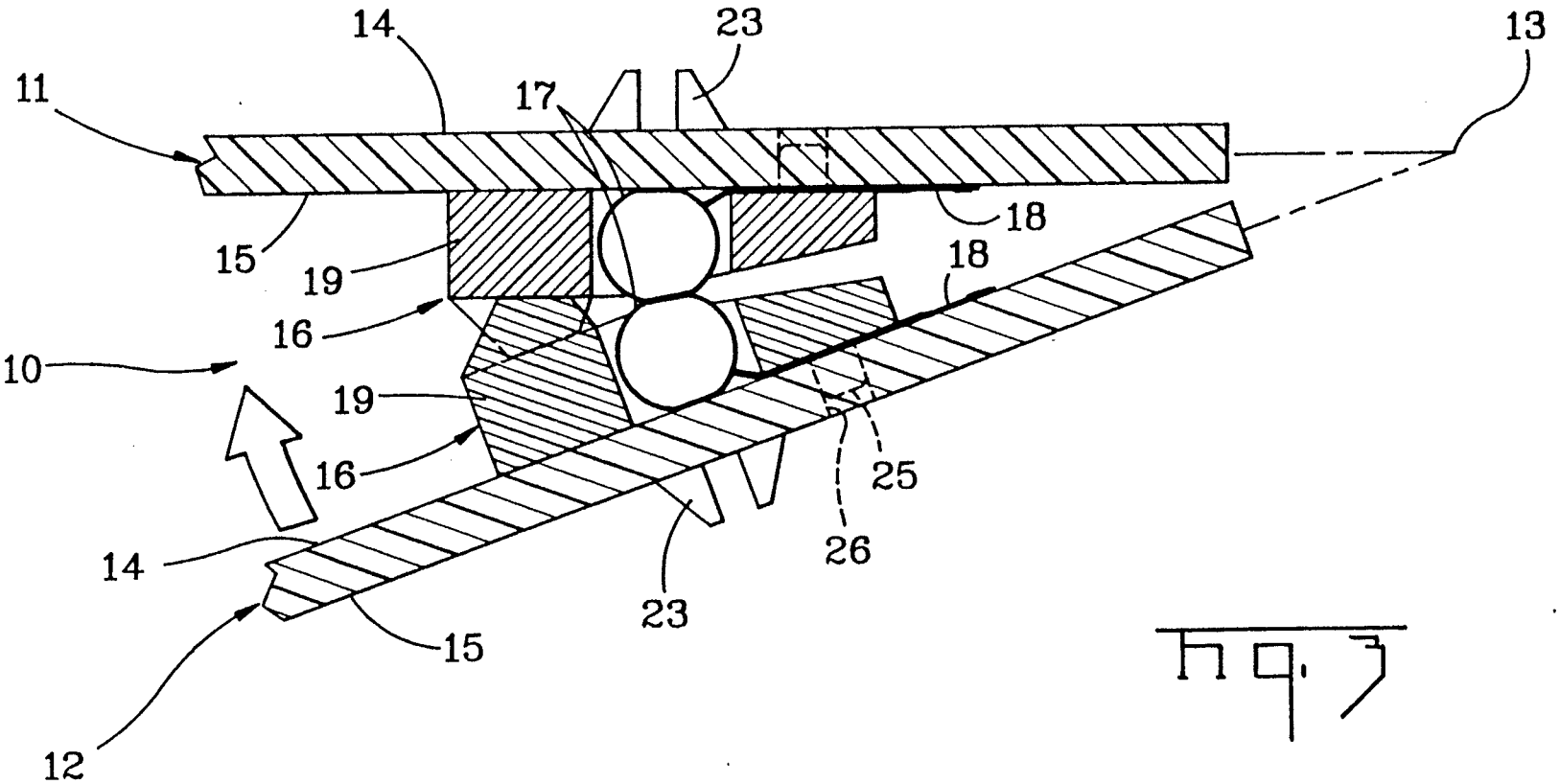
FIGS. 7A–C are further schematic sequence views, corresponding substantially to FIGS. 6A–C, but showing how the respective inclined (or beveled) surfaces on one set of guide fingers cooperate with the inclined surfaces on the other set of guide fingers—in the event the connector housings are not perfectly aligned (as otherwise shown in FIGS. 6A–C)—to laterally shift one or the other (or both) of the connector housings and hence align the PC boards.

With reference to FIGS. 1-3, an interface system 10 is provided for a pair of printed circuit boards 11 and 12 angularly converging towards each other about a pivot axis 13. In one embodiment, printed circuit board 11 is fixed, while printed circuit board 12 is pivotable about the pivot axis 13. Each of the printed circuit boards 11, 12 has a top surface 14 and a bottom surface 15.

An identical connector housing 16 is carried by each of the printed circuit boards 11, 12 remote from the pivot axis 13. In the one embodiment, a connector housing 16 is mounted on the bottom surface 15 of the fixed printed circuit board 11; and an identical connector housing 16 is mounted on the top surface 14 of the pivoted printed circuit board 12, such that the connector housings 16 are inverted with respect to each other. Since these connector housings 16 are identical, a high degree of modular design and manufacturing standardization is achieved.

Each connector housing 16 has a flexible electrical connector 17 consisting of a flexible film, having electrical circuitry thereon of gold-plated over a nickel-coated copper foil, wrapped about a suitable elastomeric core 17', and a tail portion 18 soldered (or otherwise suitably connected) to respective tin-plated circuit elements or pads (not shown) on the printed circuit boards 11, 12, thereby providing a gold-to-tin contact.

Each connector housing 16 further has a plurality of spaced-apart longitudinally-extending hermaphroditic guide fingers 19 disposed substantially parallel to the flexible electrical connector 17 and laterally offset therefrom, as shown more clearly in FIG. 1.

When one of the connector housings 16 on one of the printed circuit boards 11, 12 is turned over and engages its identical ("twin") connector housing 16 on the other printed circuit board (11 or 12), the guide fingers 19 are meshed together (as shown more clearly in FIG. 3) to thereby guide the connectors and provide a stop means between the angularly-converging printed circuit boards 11, 12.

Figure 6A:
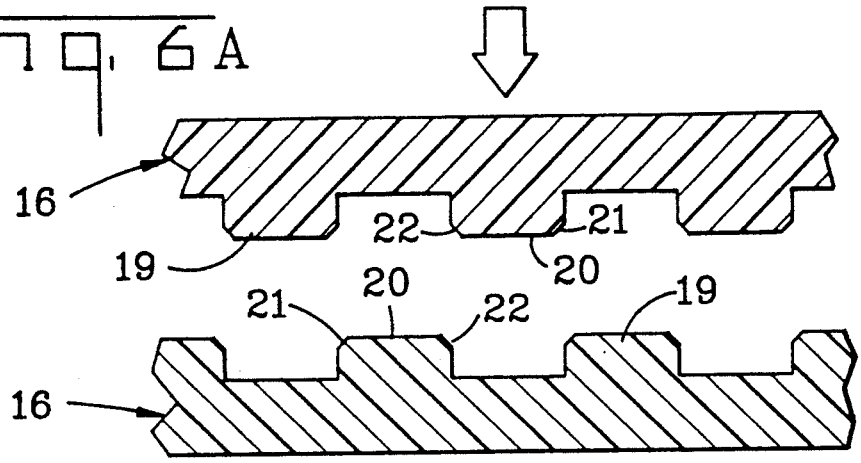
Figure 6B:
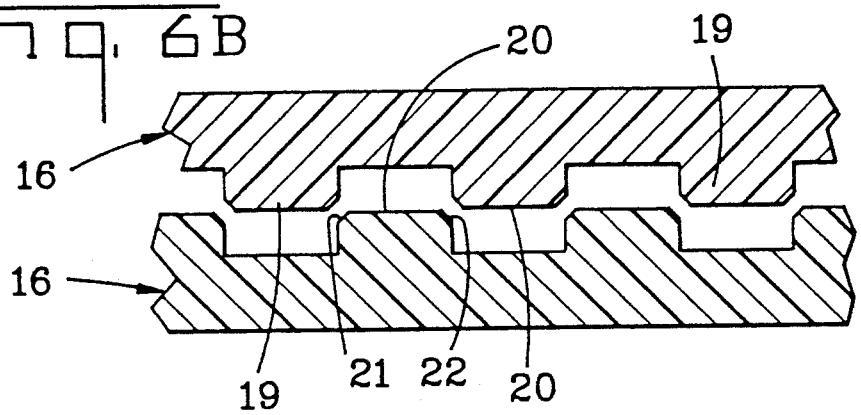
Figure 6C:
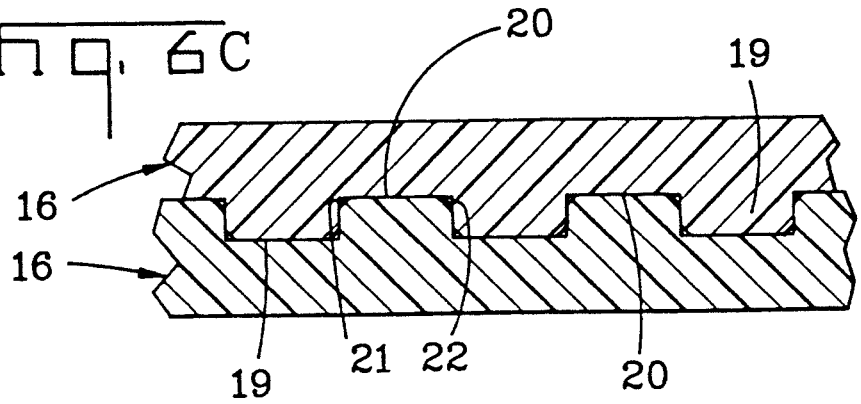
Figure 7A:
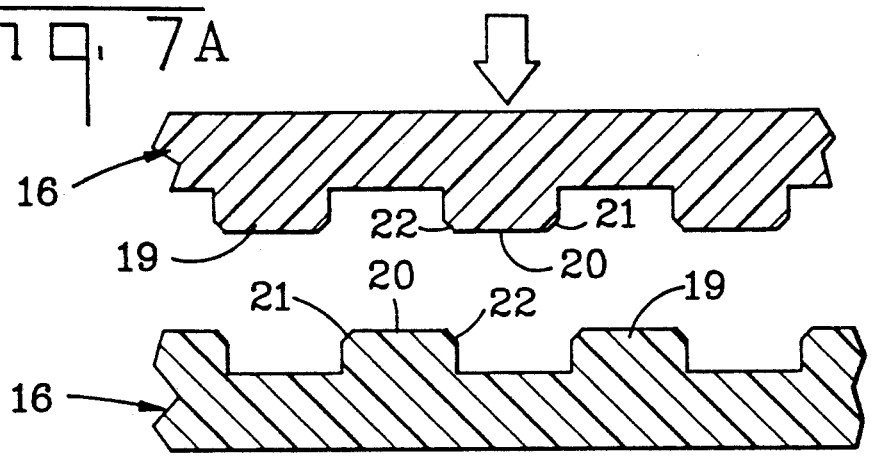
Figure 7B:
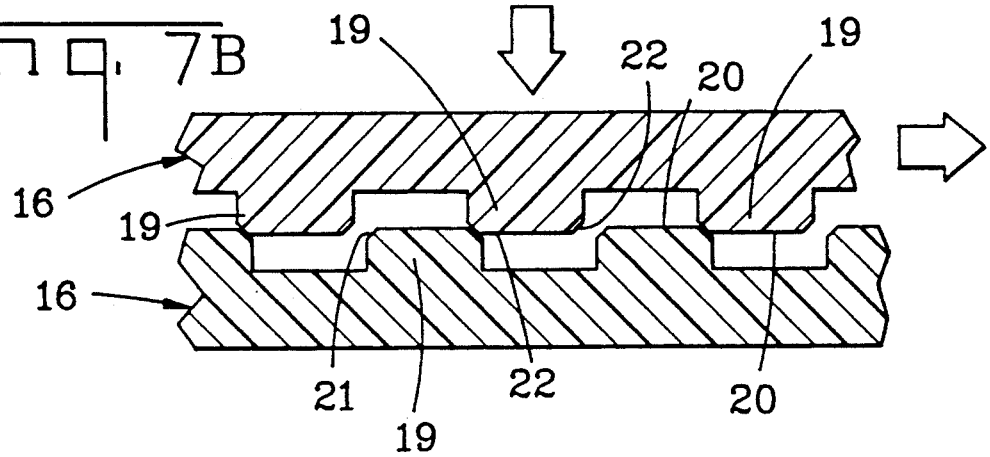
Figure 7C:
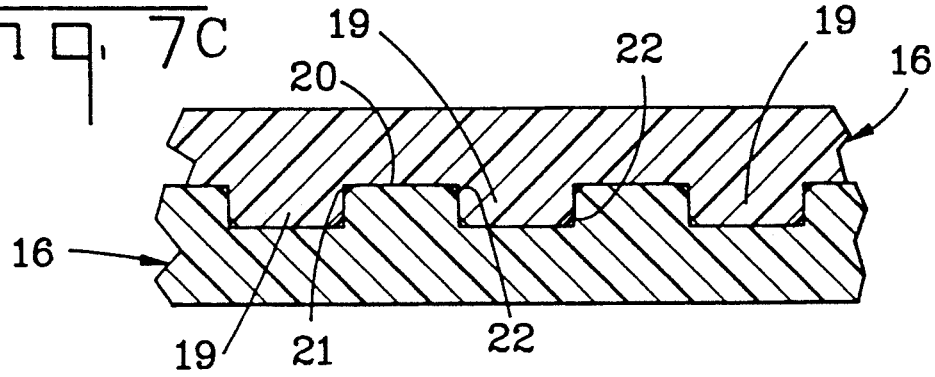

With reference again to FIG. 1, and with further reference to FIGS. 6A-C and 7A-C, each of the guide fingers 19 has a top surface 20 extending upwardly of the connector housing 16, and each top surface 20 is provided with inclined (or beveled) surfaces 21 and 22, respectively. If the printed circuit boards 11, 12 and hence the connector housings 16 thereon are perfectly aligned, as shown in FIGS. 6A-C, the guide fingers 19 will mesh perfectly with each other.

However, in product design, it is necessary to compensate for tolerance accumulations in the manufacture of the product components and, especially, in the assembly of these components in the final product. Accordingly, if the printed circuit boards 11, 12 and hence the connector housings 16 are misaligned (within the total allowed tolerance range), the respective inclined surfaces 21, 22 on the meshing guide fingers 19 will engage each other, as shown more clearly in FIGS. 7A-C, to thereby cam or shift the connector housings 16 laterally with respect to each other and in a direction which is substantially parallel to the pivot axis 13. As a result, the connector housings 16 are aligned with each other when the printed circuit boards are fully converged, and the connector housings 16 and the printed circuit boards 11, 12 are, in a sense, self-aligning. This is especially desirable, since the product manufacturers prefer "loose" tolerances for ease of assembly and low-cost manufacture without sacrificing product quality.

Figure 4:
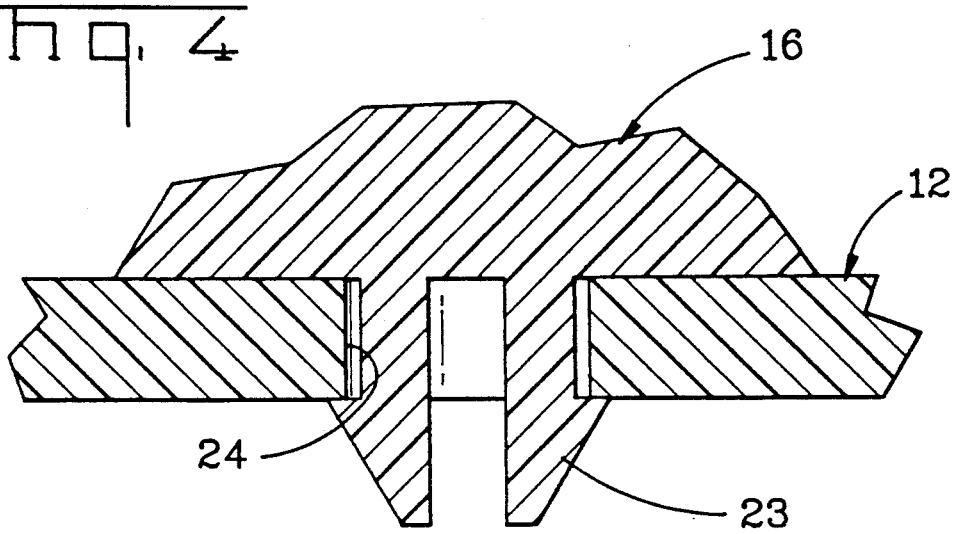
FIG. 4 is a cross-sectional view of a pair of bifurcated latching fingers carried by one of the connector housings and received in a mounting hole in a respective printed circuit board with a "snap" fit therein, thereby providing a mounting means between a connector housing and its respective printed circuit board.
Figure 5:
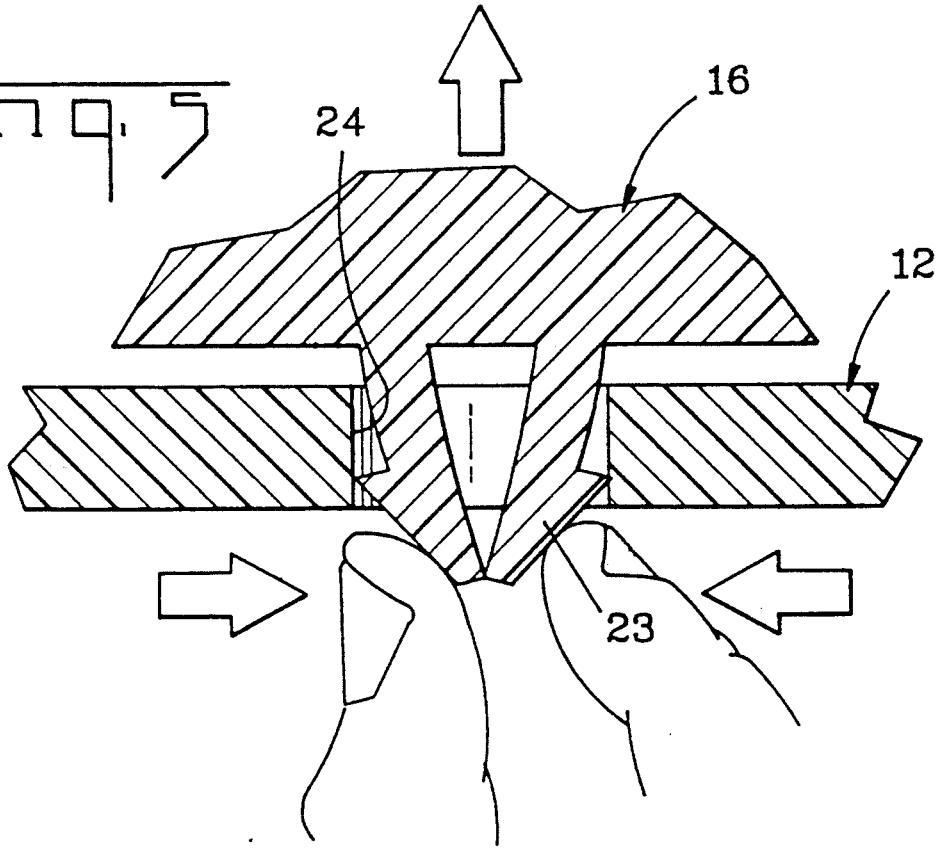
FIG. 5 is a further cross-sectional view corresponding substantially to FIG. 4, but showing how the bifurcated latching fingers may be squeezed together to quickly disconnect the connector housing from its respective printed circuit board.

With reference again to FIG. 1, and with further reference to FIGS. 4 and 5, each connector housing 16 carries at least one pair of bifurcated latching fingers 23 received within a complementary mounting hole 24 in its respective printed circuit 11 (or 12) such that each connector housing 16 may be "snapped" on to the respective printed circuit board 11 (or 12). These latching fingers 23 may be squeezed together, as shown more clearly in FIG. 5, to release the latching fingers 23 and remove the connector housing 16 from its respective printed circuit board 11 (or 12). Moreover, each connector housing 16 carries at least one alignment pin 25 received in a complementary alignment hole 26 in the printed circuit board 11 (or 12) as shown in FIGS. 2 and 3. Preferably, each connector housing 16 has two spaced-apart pairs of latching fingers 23, as shown in FIG. 1, as well as two spaced-apart alignment pins 25.

Obviously, many modifications may be made without departing from the basic spirit of the present invention. For example, the latching fingers 23 may be on the printed circuit board 11 or 12, and the complementary mounting holes 24 may be on the connector housing 16, if desired. Accordingly, it will be appreciated by those skilled in the art that within the scope of the appended claims, the invention may be practiced other than has been specifically described herein.

What is claimed is:

1. An electronic assembly to interface between a pair of angularly-converging printed circuit boards, where said boards are arranged to pivot relative to one another from a non engagement non parallel position of a first angle to one of an electrical interconnection position therebetween, where the latter position is non parallel and of a lesser angle, said assembly comprising a pair of identical connector housing mounted to a respective printed circuit board, each of said housing including at least (1) one flexible electrical connector, where said connector consists of a thin flexible film having electrical circuitry thereon wrapped around a soft, non-conducting rubber core, and (2) a plurality of uniformly spaced-apart hermaphroditic guide fingers, such that one of the connector housings may be turned over and fitted over the other connector housing, and such that the hermaphroditic guide fingers mesh therebetween, thereby providing guide means and a stop means between the connectors housing as the flexible electrical connectors engage each other.

2. The electronic assembly according to claim 1, further including mounting means between each connector housing and its respective means between each connector housing and its respective printed circuit board, the mounting means comprising respective pairs of bifurcated latching fingers on the connector housing, and each printed circuit board having a corresponding respective pair of space-apart mounting holes, such that each pair of bifurcated latching fingers may be "snapped" into a respective mounting hole on the printed circuit board, and such that the bifurcated latching fingers may be squeezed together to remove the connector housing from the printed circuit board.

3. The electronic assembly according to claim 2, wherein each connector housing has a pair of alignment pins, and wherein each printed circuit board is provided with a pair of guide holes for receiving with respective alignment pins.

4. The electronic assembly according to claim 1, wherein each guide finger has a top surface extending upwardly of the connector housing, and wherein each top surface is provided with a pair of spaced-apart beveled surfaces, such that as the connector housings are brought together and the guide fingers on the one connector housing mesh with the guide fingers on the other connector housing, the beveled surfaces on the guide fingers on the one connector housing engage the beveled surfaces on the guide fingers on the other connector housing, thereby aligning the guide fingers on the one connector housing with the guide fingers on the other connector housing.

5. The electronic assembly according to claim 1, wherein each flexible electrical connector has a tail portion suitably connected to its respective printed circuit board.

* * * * *

UNITED STATES PATENT AND TRADEMARK OFFICE

CERTIFICATE OF CORRECTION

PATENT NO. : 5,306,161

DATED : April 26, 1994

INVENTOR(S) : Keith L. Volz et al.

It is certified that error appears in the above-identified patent and that said Letters Patent is hereby corrected as shown below:

Claim 1, column 4, line 9, "housing" should be --housings--.

Claim 2, column 4, line 3, delete "means between each connector housing and its respective".

Claim 3, column 4, line 4, "with" second occurence" should be --the--.

Signed and Sealed this

Tenth Day of October, 1995

*Attest:*

Bruce Lehman

BRUCE LEHMAN

*Attesting Officer*

*Commissioner of Patents and Trademarks*